US006604398B1

(12) United States Patent
Hansen

(10) Patent No.: US 6,604,398 B1
(45) Date of Patent: Aug. 12, 2003

(54) WORKING METHOD AND INSTALLATION FOR THE FLEXIBLE AND ECONOMICAL PICKLING AND COLD-ROLLING OF METAL STRIPS

(75) Inventor: Manfred Hansen, Düsseldorf (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/889,641

(22) PCT Filed: Jan. 18, 2000

(86) PCT No.: PCT/DE00/00186

§ 371 (c)(1),
(2), (4) Date: Jul. 19, 2001

(87) PCT Pub. No.: WO00/45971

PCT Pub. Date: Aug. 10, 2000

(30) Foreign Application Priority Data

Feb. 3, 1999 (DE) ..... 199 05 286

(51) Int. Cl.[7] ..... B21B 15/00; B21B 45/04

(52) U.S. Cl. ..... 72/206; 72/39; 72/229; 72/366.2; 72/148

(58) Field of Search ..... 72/39, 206, 229, 72/250, 366.2, 146, 148; 242/533.2, 533.3, 533.7

(56) References Cited

U.S. PATENT DOCUMENTS 3,918,282 A 11/1975 Eibe ..... 72/39
5,329,688 A * 7/1994 Arvedi et al. ..... 29/527.7
5,495,736 A 3/1996 Nishi et al. ..... 72/39
5,927,127 A * 7/1999 Klamma et al. ..... 72/229
6,068,708 A * 5/2000 Lauer et al. ..... 148/111

FOREIGN PATENT DOCUMENTS

JP 7-164008 6/1995

* cited by examiner

*Primary Examiner*—Ed Tolan
(74) *Attorney, Agent, or Firm*—Cohen, Pontani, Lieberman & Pavane

(57) ABSTRACT

The installation includes an in-line arrangement of a metal pickler, a reeling arrangement installed on the coiling side of the metal pickler, and a cold-rolling mill. The method includes ones of the following alternative sequences of work steps:

(a) the strip leaving the metal pickler bypasses the reeling arrangement and is introduced into the cold-rolling mill for a first reduction pass and rolled out over the course of several deformation passes; or (b) the strip leaving the metal pickler is wound on the reeling arrangement into a coil; after the coil is switched to the uncoiling position, the strip is fed into the cold-rolling mill and rolled out over the course of several deformation passes; or (c) the strip leaving the metal pickler is wound as hot-rolled strip on the reeling arrangement to obtain the finished strip; or (d) pre-pickled, hot-rolled strips are sent to the reeling arrangement and then uncoiled from the uncoiler into the cold-rolling mill and rolled in several deformation passes.

9 Claims, 1 Drawing Sheet

WORKING METHOD AND INSTALLATION FOR THE FLEXIBLE AND ECONOMICAL PICKLING AND COLD-ROLLING OF METAL STRIPS

This is a U.S. national stage of application of PCT/DE00/00186, filed on Jan. 18, 2000. Priority is claimed on that application and on the following application: Country: Germany, Application No.: 199 05 286.7, filed Feb. 3, 1999.

BACKGROUND OF THE INVENTION

1. Field of the Invention

The invention pertains to a working method and to an installation for the flexible and economical pickling and cold-rolling of metal strip, especially in small-to-medium production volumes on an installation consisting of an in-line arrangement of a metal pickler, a reeling arrangement on the coiling side of the metal pickler, and a cold-rolling mill.

2. Description of the Related Art

It is known that metal picklers and rolling mills can be connected and operated as so-called "endless rolling mills". These mill layouts offer many advantages because of the elimination of the discontinuous threading operation, and they usually provide very high production rates per unit time. They require such a large investment, however, that many operators of installations for smaller production volumes continue to invest in separate metal picklers and rolling mills.

In order to achieve higher production rates in spite of this difficulty, multi-stand reversing mills and/or the creation of extremely large coils only for the section between the metal pickler and the mill have been proposed, these large coils being uncoiled and cut downline from the mill so that they are small enough to be transported and subjected to further processing (U.S. Pat. No. 5,495,736). Installations of this type require extremely large custom equipment for the coiling machines, which appears to cast doubt on the cost advantages.

SUMMARY OF THE INVENTION

The task of the present invention is to create a process and an installation by means of which an extremely flexible pickling-and-rolling operation for small-to-medium production volumes can be achieved economically without the need to add or omit any system components for operational reasons, with minimal investment and personnel costs, and with the use of conventional coil sizes and machine dimensions.

To accomplish this task with the use of a given installation consisting of an in-line arrangement of a metal pickler, a reeling arrangement on the coiling side of the metal pickler, and a cold-rolling mill, a working method is proposed which is characterized by various alternative sequences of work steps:

(a) the strip leaving the metal pickler bypasses the reeling arrangement and is introduced into the cold-rolling mill for a first reduction pass and rolled out over the course of several deformation passes; or (b) the strip leaving the metal pickler is wound on the reeling arrangement into a coil; after the coil is switched to the uncoiling position, the strip is fed into the cold-rolling mill and rolled out over the course of several deformation passes; or (c) the strip leaving the metal pickler is wound as hot-rolled strip on the reeling arrangement to obtain the finished strip; or (d) pre-pickled, hot-rolled strips are sent to the reeling arrangement and then uncoiled from the uncoiler into the cold-rolling mill and rolled in several deformation passes.

In the solution proposed according to the invention, a so-called "partial coupling" of a metal pickler and rolling mill is set up in a consistent manner so that all three operating modes, i.e., endless rolling, partial coupling, and discontinuous operation, can be run equally well on one and the same installation.

In accordance with an embodiment of the invention, it is preferably provided that the cold-rolling is done on a reversing mill into which the strip produced according to work step (a), (b), or (c) is introduced and rolled out over the course of several reversing passes, where the strip, after one or more reversing passes, is wound on at least one of the reversing reels, one of which is installed at each end of the reversing mill.

According to another feature of the invention, it is also an effective option to cold-roll the strip produced according to work step (a), (b), or (d) on a 2-stand or 3-stand tandem line, on which the strip, is rolled out in a single pass, or, in accordance with another alternative, to wind the strip after one or more reversing passes on at least one of the two reversing reels, one of which is installed at each end of the tandem line.

An installation for the flexible and economical pickling and cold-rolling of metal strip according to the work steps defined according to the invention is characterized by a reeling arrangement, which is designed as a horizontal or vertical reverse coiler with two separate drive units, one for each reel mandrel, these drives preferably being disconnected when the reeling arrangement is reversed. Layouts of this type are known in principle; only its inclusion in the complete installation according to the invention for performing all of the work steps in question is claimed by the present invention.

It is favorable for the reel mandrels of the reverse coiler to be free to move in the axial direction in their housings, so that, as the coil is being fed out from the reel mandrel downstream from the metal pickler, it can be kept centered as it enters the rolling mill.

The reversing mill can be designed as a conventional reversing stand or as a 2-stand or 3-stand tandem group with a reversing reel installed at each end of the tandem group. As soon as the reversing reel of the reversing stand has accepted the strip, the reel mandrel of the reverse coiler is free again to form a new coil from the strip coming from the metal pickler.

Especially when high pass reductions are required, e.g., when rolling is performed in only a single pass, it is favorable for the cold-rolling mill to be equipped with 6-high stands, which allow a greater degree of deformation.

An installation according to the invention for implementing the working method is extremely flexible, needs only a minimum of operating personnel, requires little room, has low investment costs, and shows its greatest economy in conjunction with the use of the thin, hot-rolled strip which is being produced increasingly in thin slab plants and strip-casting plants.

DETAILED DESCRIPTION OF THE PREFERRED EMBODIMENTS

Figure 2:
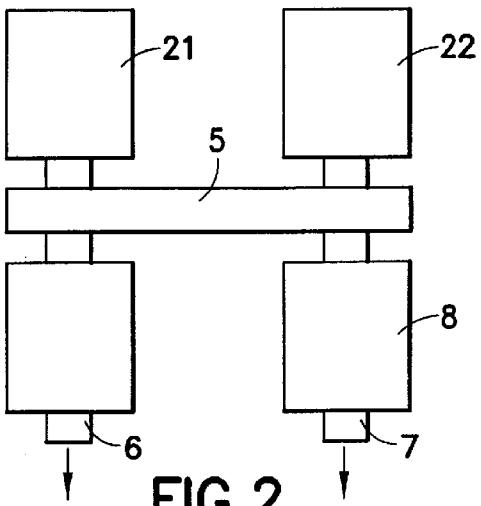
FIG. 2 is a schematic plan view of the reeling arrangement.

The strip B, which has been uncoiled from an uncoiler reel 1, is first subjected to conventional preparation and then sent over the set of drive rolls 2 of the metal pickler 3, designed as a push pickler, to processing. The metal pickler 3 is equipped on the delivery side, downstream from the conventional auxiliary devices 4 such as scrubbers, scrap shears, and parting shears, with a horizontal revere coiler 5, onto which the strip B leaving the metal pickler is coiled. The reverse coiler 5 has a coiling reel mandrel 6 and an uncoiling reel mandrel 7 with separate drives 20, 21, as shown in FIG. 2. That is, each reel mandrel has its own drive unit, which is preferably disconnected when the reel is reversed. The uncoiling reel mandrel 7 and the coiling reel mandrel 6 are installed in the housing in such a way that they can move in the axial direction, as indicated by arrows, so that the uncoiling reel mandrel 7 facing away from the metal pickler 3 can feed out the coil 8, which has been coiled up downstream from the metal pickler 3, in a controlled manner so that it is kept centered as it enters the following reversing mill 9.

The reversing mill 9 consists of a traditional reversing stand, which, after the first reduction pass, sends the coil 8 to the reversing reel 10. The uncoiling reel mandrel 7 of the reverse coiler 5 is then free to switch places with the coiling reel mandrel 6 and can accept a new strip coming from the metal pickler 3.

Figure 1:
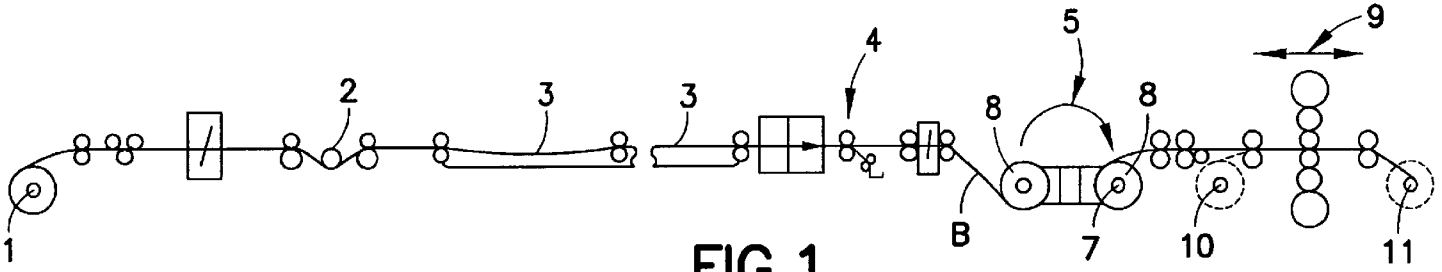
FIG. 1 is a schematic illustration of an installation according to the invention.
Figure 1A:
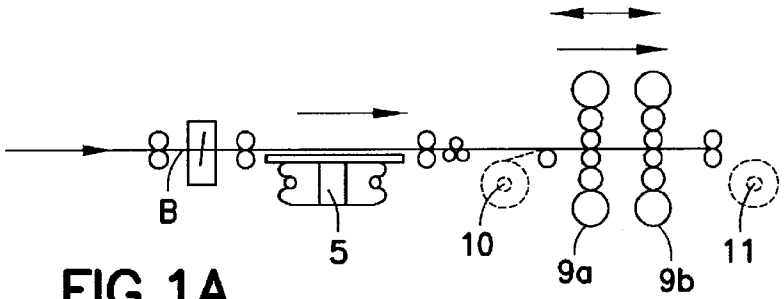
FIG. 1A is an alternative embodiment of reversing mill, having tandem roll stands.

The reversing stand 9, as shown FIG. 1A, can also be a 2-stand or 3-stand tandem train with stands 9*a*, 9*b*. These are preferably designed as 6-high systems (in which the relatively small work rolls are supported by intermediate and backup rolls) for high reductions (more than 50% in the first stand), so that some of the pickled strips B can be rolled in a single pass. In this case, as illustrated, the strip can simply travel over the top of the reverse coiler 5 in so-called endless operating mode.

If several passes are required in the reversing mill, the metal pickler 3 can easily prepare so-called P & O coils, which are not cold-rolled, during the associated waiting periods. The strip B in this case is coiled downstream from the metal pickler 3 on the coiling reel mandrel 6 of the reverse coiler 5 and delivered as finished product. P & O coils of this type can, of course, also be pickled during long breaks in the operation of the reversing mill 9, such as those which occur when the backup rolls are being replaced.

The flexibility of the installation also means that coils 8 which have already been pickled and held in storage can be rolled out in the reversing mill 9 during the times that the metal pickler 3 is out of service. These coils 8 are supplied to the uncoiling reel mandrel 7 of the reverse coiler 5, where they are uncoiled and sent to the reversing mill 9.

What is claimed is:

1. Apparatus for pickling and cold-rolling metal strip, said apparatus comprising:

a metal pickler, a reeling arrangement comprising one of a horizontal and a vertical reverse-coiler, said reverse coiler comprising a coiling reel mandrel, an uncoiling reel mandrel, and a separate drive unit for each mandrel, said mandrels being axially movable, said drive units being disconnectable from the mandrels when the reels are reversed, and a cold-rolling mill which is a reversing mill.

2. Apparatus as in claim 1 wherein said cold-rolling mill is one of a two-stand and a three-stand tandem line, said apparatus further comprising a reversing reel at each end of the tandem line.

3. Apparatus as in claim 2 wherein each said stand is a six-high stand.

4. A method for pickling and cold rolling metal strip in an installation comprising an in-line arrangement of a metal pickler, a reeling arrangement comprising a coiler and an uncoiler, and a cold-rolling mill, said method comprising the following serial steps:

passing a metal strip through the pickler, introducing the strip to the reeling arrangement, winding the strip into a coil on the coiler, switching the coil to the uncoiler, uncoiling the strip from the coil into the cold-rolling mill for a first reduction pass, and rolling out said strip in several deformation passes.

5. A method as in claim 4 wherein said cold-rolling mill is a reversing mill, said deformation passes being reversing passes, said installation further comprising a reversing reel at each end of the reversing mill, said method further comprising winding said strip on at least one of said reversing reels after at least one of said reversing passes.

6. A method as in claim 4 wherein said cold-rolling mill is one of a two-stand and a three-stand tandem line, said deformation passes being a single pass through said stands.

7. A method as in claim 4 wherein said cold-rolling mill is one of a two-stand and a three-stand tandem line, said deformation passes being reversing passes through said tandem line, said installation further comprising a reversing reel at each end of the tandem line, said method further comprising winding said strip on at least one of said reversing reels after at least one of said reversing passes.

8. A method as in claim 4 wherein said reeling arrangement comprises a mandrel and a drive for each of said coiler and said uncoiler, said method further comprising disconnecting said drives from said mandrels after winding said strip into a coil on said coiler, whereby said coil can be switched to said uncoiler.

9. A method as in claim 8 wherein said mandrels are axially movable, said method further comprising moving said mandrels axially after disconnecting said drives from said mandrels.

* * * * *